US008590639B2

(12) United States Patent
Connell

(10) Patent No.: US 8,590,639 B2
(45) Date of Patent: Nov. 26, 2013

(54) ARTICULATED PRE-SKIMMER MOUNT

(75) Inventor: Stuart A. Connell, Sherman, TX (US)

(73) Assignee: Caterpillar Global Mining Equipment LLC, South Milwaukee, WI (US)

( * ) Notice: Subject to any disclaimer, the term of this patent is extended or adjusted under 35 U.S.C. 154(b) by 468 days.

(21) Appl. No.: 13/026,411

(22) Filed: Feb. 14, 2011

(65) Prior Publication Data

US 2011/0198130 A1 Aug. 18, 2011

Related U.S. Application Data

(60) Provisional application No. 61/304,949, filed on Feb. 16, 2010.

(51) Int. Cl.
*E21B 21/00* (2006.01)

(52) U.S. Cl.
USPC ..... 175/207; 175/52; 175/85; 175/161; 175/88; 173/184; 173/1

(58) Field of Classification Search
USPC ..... 248/274.1; 175/88, 85, 52, 58, 161, 175/207, 284; 173/1, 133, 184
See application file for complete search history.

(56) References Cited

U.S. PATENT DOCUMENTS 6,655,474 B1 * 12/2003 Accorroni ..... 175/58
6,698,978 B2 * 3/2004 Albertson et al. ..... 405/148
7,658,240 B2 * 2/2010 Anderson ..... 175/19
7,950,470 B2 * 5/2011 Reid ..... 173/90
2005/0029015 A1 2/2005 Burnett et al.
2005/0061548 A1 * 3/2005 Hooper et al. ..... 175/52
2007/0193750 A1 8/2007 Wright et al.
2009/0274543 A1 11/2009 Grotherr et al.

FOREIGN PATENT DOCUMENTS

EP 0 138 363 4/1985

OTHER PUBLICATIONS

International Search Report for Application No. PCT/US2011/024711, mail date Aug. 2, 2011, 6 pages.

* cited by examiner

*Primary Examiner* — Todd M. Epps
(74) *Attorney, Agent, or Firm* — Foley & Lardner LLP

(57) ABSTRACT

An articulated pre-skimmer mount for a pre-skimmer associated with a drill bit feed unit comprises a feed mounting arm mounted to the drill bit feed unit. A first end is configured for attachment to the drill feed unit and a second end includes a cylindrical mounting shaft and an axial positioning plate. An intermediate arm has a first end comprising a cylindrical sleeve mounted thereto. The cylindrical sleeve has an inner cylindrical opening configured for sliding engagement with the cylindrical mounting shaft and a mating plate configured for locking, face-to-face engagement with the axial positioning plate. A second end comprises a pre-skimmer mounting assembly configured for attachment to the pre-skimmer, wherein an axial positioning plate and a mating plate are operable to disengage, for rotation of the intermediate arm about an axis of the feed mounting arm for alignment of the pre-skimmer.

9 Claims, 6 Drawing Sheets

ARTICULATED PRE-SKIMMER MOUNT

CROSS-REFERENCE

This patent application claims priority to U.S. Provisional Patent Application Ser. No. 61/304,949 filed Feb. 16, 2010 which is incorporated herein by reference in its entirety.

FIELD OF THE INVENTION

Exemplary embodiments relate to an apparatus for the removal of cuttings from a drill hole and, more particularly, to a particulate skimmer apparatus having an articulated mount.

BACKGROUND

It is common in mining operations to utilize a mobile drilling platform for drilling holes in various earth formations for the placement of explosives, for example, for the loosening of earth to be removed by excavation. During the drilling of a hole in a formation, compressed air may be used to flush cuttings out of the hole being drilled. Due to health and environmental concerns the cuttings being flushed out of the hole may be gathered and filtered to limit their released into the environment. A dust collection system may be utilized with the mobile drill unit and may comprise a pickup, a pre-skimmer or centrifugal separator and a dust collector. The dust collector establishes a vacuum that draws the cuttings into the dust pickup pot, through the pre-skimmer and into the dust collector itself.

The pre-skimmer is designed to separate larger cuttings that will drop through a bottom chute with smaller and lighter particles continuing to the dust collector where there are filtered from the air flow by mechanical means such as filters. For the pre-skimmer to work most efficiently, and to avoid clogging, it should be mounted vertically, with respect to the ground, in order for the larger/heavier particles separated from the cuttings to drop out of a bottom chute.

Since drilling may often occur in a non-vertical orientation it is often necessary to reorient the pre-skimmer, with respect to the drill feed, in order to maintain its desired vertical orientation. Such reorientation of the pre-skimmer in the field may be time consuming, thereby lowering operational efficiency.

SUMMARY

In an exemplary embodiment an articulated pre-skimmer mount for a pre-skimmer associated with a drill bit feed unit comprises a feed mounting arm mounted to, and extending outwardly from the drill bit feed unit. The feed mounting arm comprises a first end configured for attachment to the drill bit feed unit, a second end including a cylindrical mounting shaft and an axial positioning plate located intermediate of the first and the second ends. An intermediate arm has a first end comprising a cylindrical sleeve mounted thereto. The cylindrical sleeve has an inner cylindrical opening configured for sliding engagement with the cylindrical mounting shaft and a mating plate located on the sleeve and configured for locking, face-to-face engagement with the axial positioning plate. A second end comprises a pre-skimmer mounting assembly configured for attachment to the pre-skimmer, wherein the axial positioning plate and the mating plate are operable to disengage, for rotation of the intermediate arm about an axis of the feed mounting arm to position the pre-skimmer and to re-engage to fix the pre-skimmer in position.

In another exemplary embodiment an articulated pre-skimmer mount for a pre-skimmer associated with a drill bit feed unit comprises a feed mounting arm mounted to, and extending outwardly from the drill bit feed unit comprising a first end configured for attachment to the drill bit feed unit, a second end including a cylindrical mounting shaft, and an axial positioning plate located intermediate of the first and the second ends. An intermediate arm has a first end comprising a cylindrical sleeve mounted thereto. The cylindrical sleeve has an inner cylindrical opening configured for sliding engagement with the cylindrical mounting shaft and a mating plate located on the sleeve and configured for locking, face-to-face engagement with the axial positioning plate. A second comprises a pre-skimmer mounting assembly configured for attachment to the pre-skimmer, wherein the axial positioning plate and the mating plate are operable to disengage, for rotation of the intermediate arm about an axis of the feed mounting arm to position the pre-skimmer and to re-engage to fix the pre-skimmer in position. A second cylindrical mounting shaft extending outwardly from the second end of the intermediate arm and a second cylindrical sleeve configured for sliding engagement with the second cylindrical sleeve. A second mating plate is located on the second cylindrical sleeve and is configured for locking, face-to-face engagement with a second axial positioning plate mounted to the second cylindrical mounting shaft, wherein the second axial positioning plate and the second mating plate are operable to disengage, for rotation of the pre-skimmer mounting assembly about an axis of the second cylindrical mounting shaft and to re-engage to fix the pre-skimmer in position.

The above features and advantages, and other features and advantages of the present invention are readily apparent from the following detailed description of the invention when taken in connection with the accompanying drawings.

DESCRIPTION OF THE EMBODIMENTS

Figure 1:
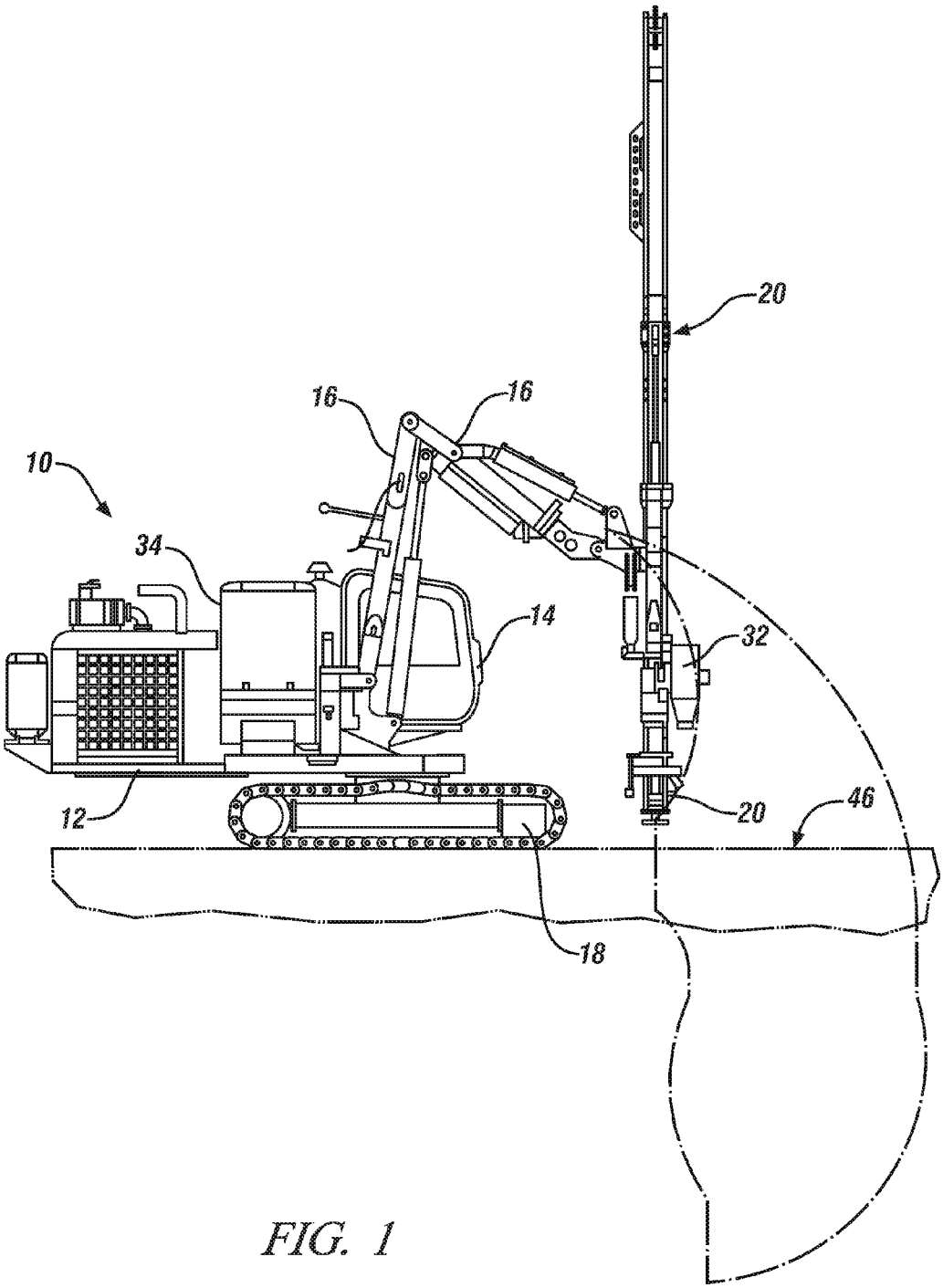
FIG. 1 is a side view of a mobile drilling platform embodying features of the invention.

The following description is merely exemplary in nature and is not intended to limit the present disclosure, its application or uses. It should be understood that throughout the drawings, corresponding reference numerals indicate like or corresponding parts and features.

Figure 2:
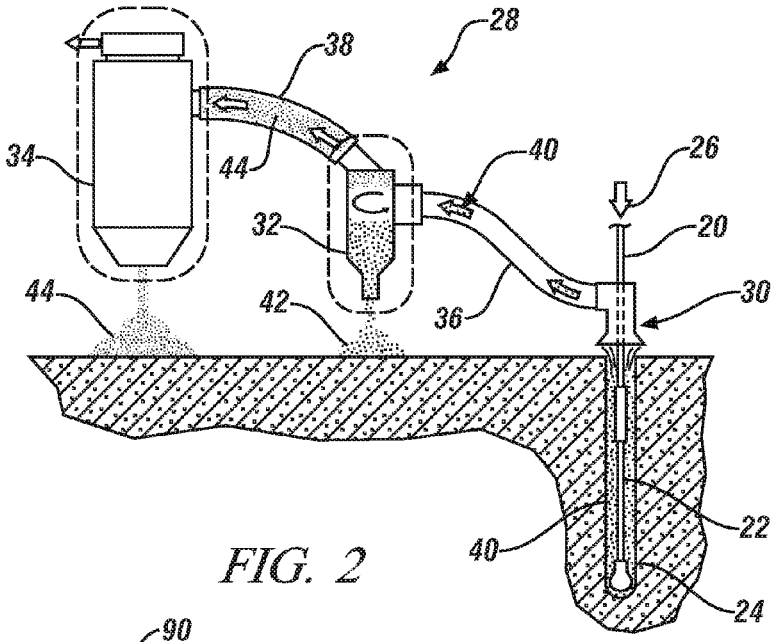
FIG. 2 is a schematic view of components of a cutting removal system embodying features of the invention.

Referring to FIGS. 1 and 2 an exemplary embodiment is directed to a mobile drill platform 10, comprising a power unit 12 having an operator's cab 14 and a boom 16, mounted for rotatable movement on a mobile platform 18. The boom 16 is configured to support and operate a drill feed unit 20 for hole drilling in an earth formation. The drill feed unit 20 feeds a drill bit 22 into the earth formation to form a bore hole 24. As the bore hole 24 is formed by the drill bit 22, the drill feed unit 20 supplies compressed air 26, FIG. 2, into the bore hole 24. A dust collection system 28 includes a pick up 30 located proximate to the bore hole 24. A first conduit 36 extends between, and fluidly connects, the pick up 30 with a pre-skimmer or centrifugal separator 32. In like fashion a second conduit 38 extends between, and fluidly connects, the pre-skimmer 32 with a dust collector 34 that may be mounted on the mobile drill platform 10. The dust collector 34 establishes a vacuum in first and second conduits 36, 38 that draws cuttings and particulates 40 from the bore hole 24 through pick up 30, pre-skimmer 32 and into the dust collector 34. During operation of the drill feed unit 20 cuttings and particulates 40 are drawn out of the bore hole 24, through the first conduit 36 and into pre-skimmer 32 where larger and heavier components 42 of the cuttings and particulates 40 are removed. Subsequently, lighter components 44 of the cuttings and particulates 40 are drawn into the dust collector 34 where they are removed from the air flow by suitable mechanical means such as a filter (not shown).

Figure 6:
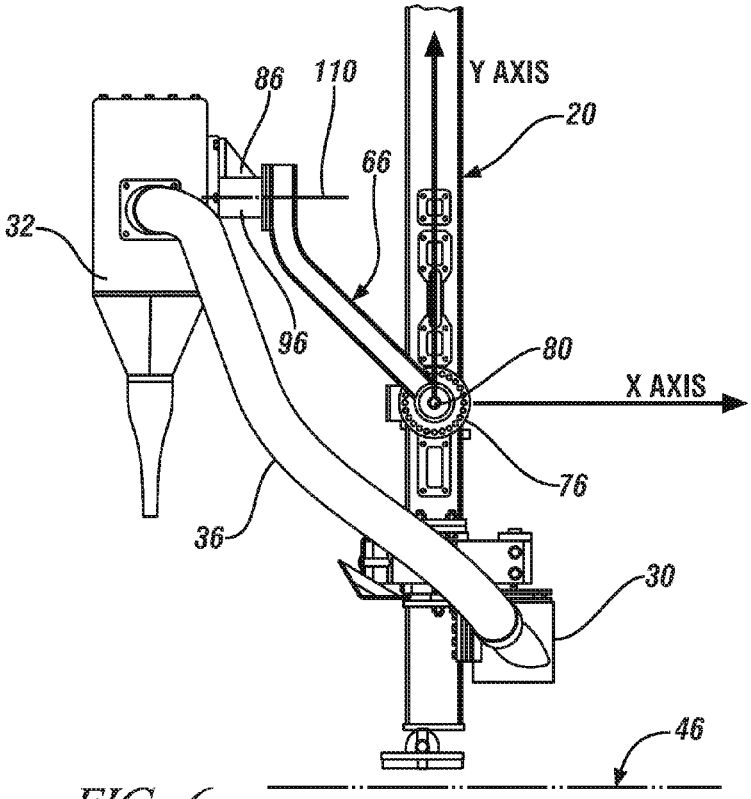
FIG. 6 is a side view of a drill feed and pre-skimmer with the drill feed shown in a vertical position.
Figure 7:
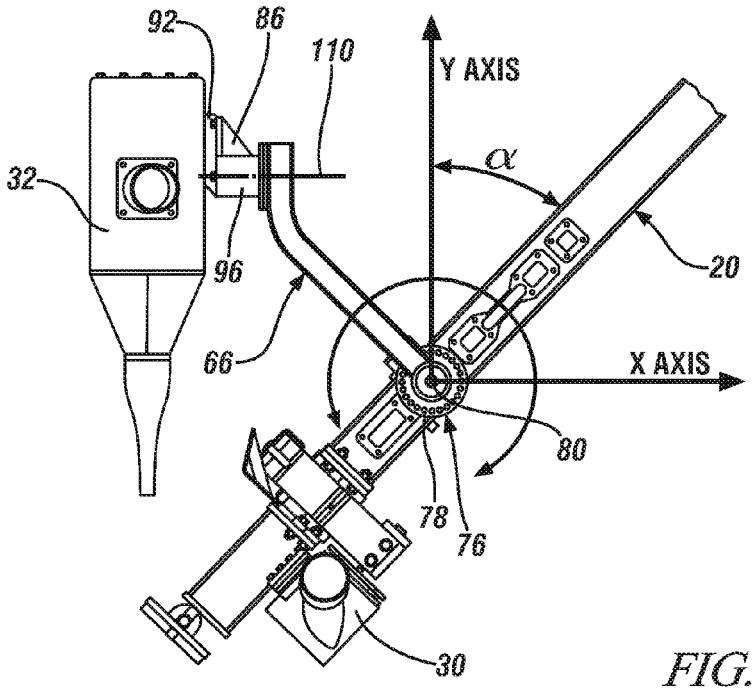
FIG. 7 is a side view of a drill feed and pre-skimmer with the drill feed shown in an angled position.
Figure 9:
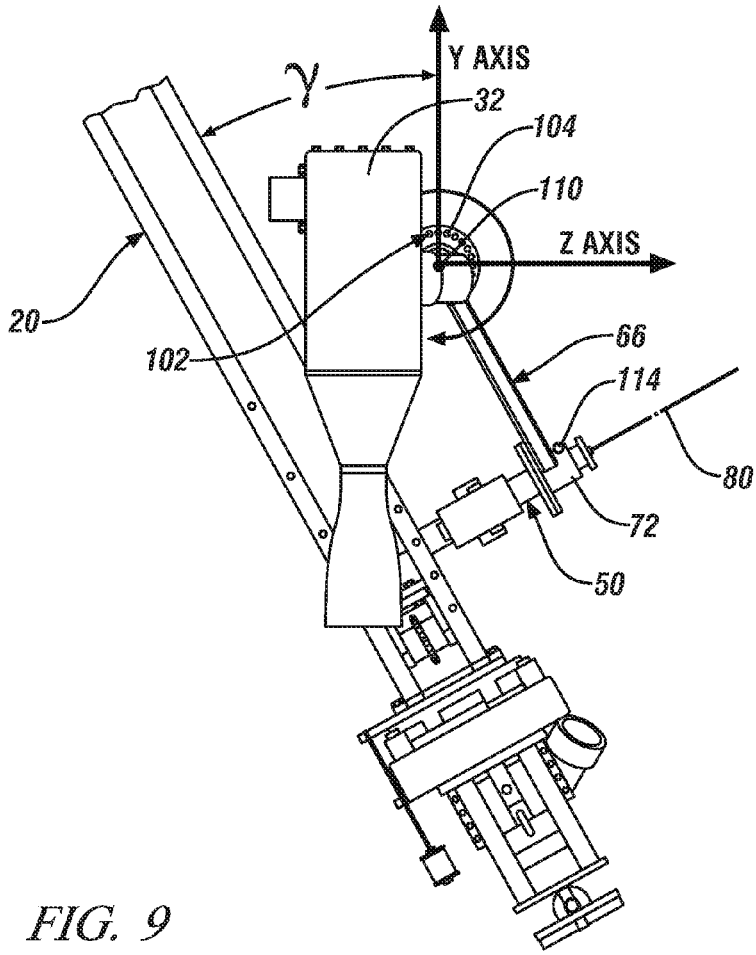
FIG. 9 is a rear view of a drill feed and pre-skimmer with the drill feed shown in an angled position.
Figure 10:
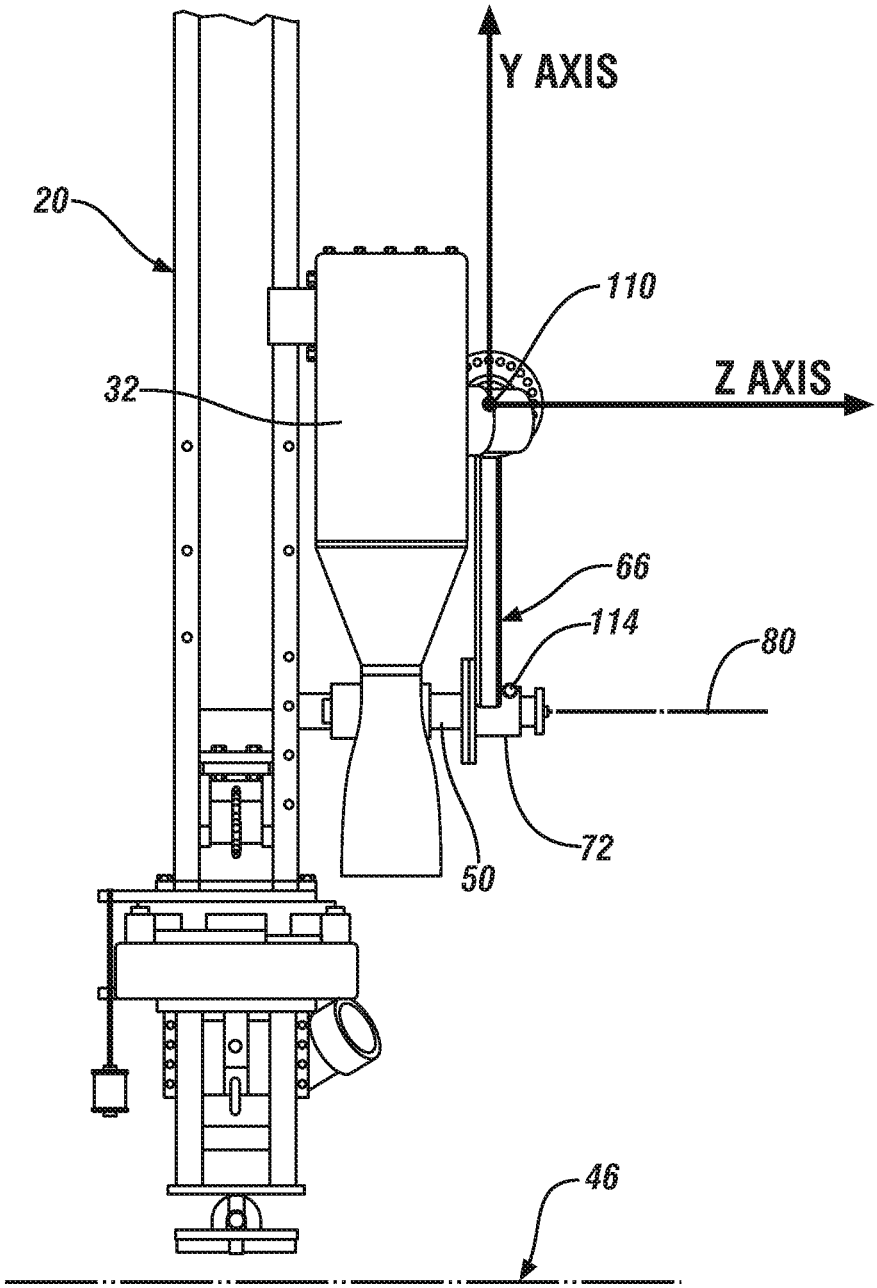
FIG. 10 is a rear view of a drill feed and pre-skimmer with the drill feed shown in a vertical position.

During operation of the dust collecting system 28, it is desirable to maintain the pre-skimmer 32 in a vertical position relative to the ground 46 in order to assure efficient operation and to prevent clogging thereof. FIGS. 6 and 10 illustrate operation of the drill feed unit 20 and the pre-skimmer 32 in a vertical position relative to the x, y and z axes. The x and the z axes are parallel with the ground 46 and the y axis represents vertical. FIGS. 7 and 9 illustrate operation of the drill feed unit 20 and the pre-skimmer 32, where the drill feed unit 20 is operated at an angle to the y axis. In this operation situation, and in order to maintain efficient operation of the pre-skimmer 32, the pre-skimmer must be reoriented with respect to the drill feed unit 20 such that it remains parallel with the y axis (i.e. vertical with respect x and z axes).

Figure 3:
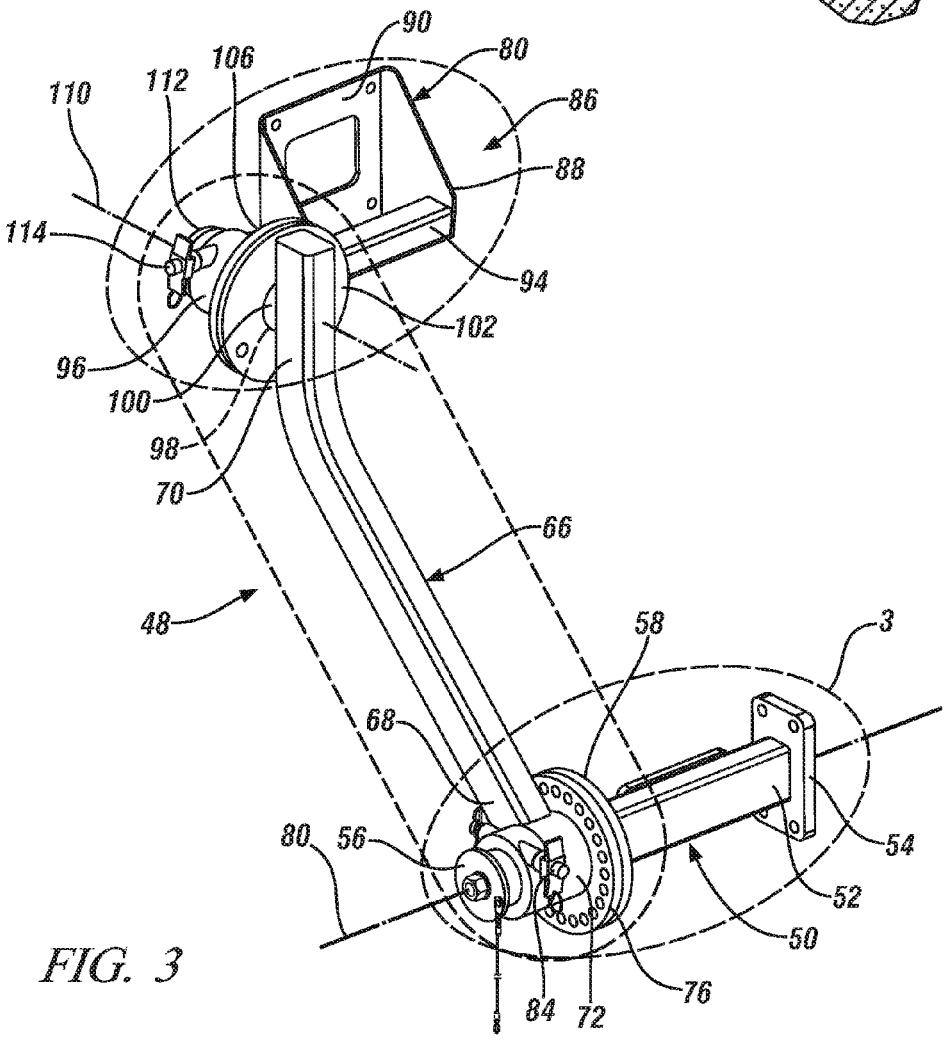
FIG. 3 is a perspective view of an articulated pre-skimmer mounting system embodying features of the invention.
Figure 4:
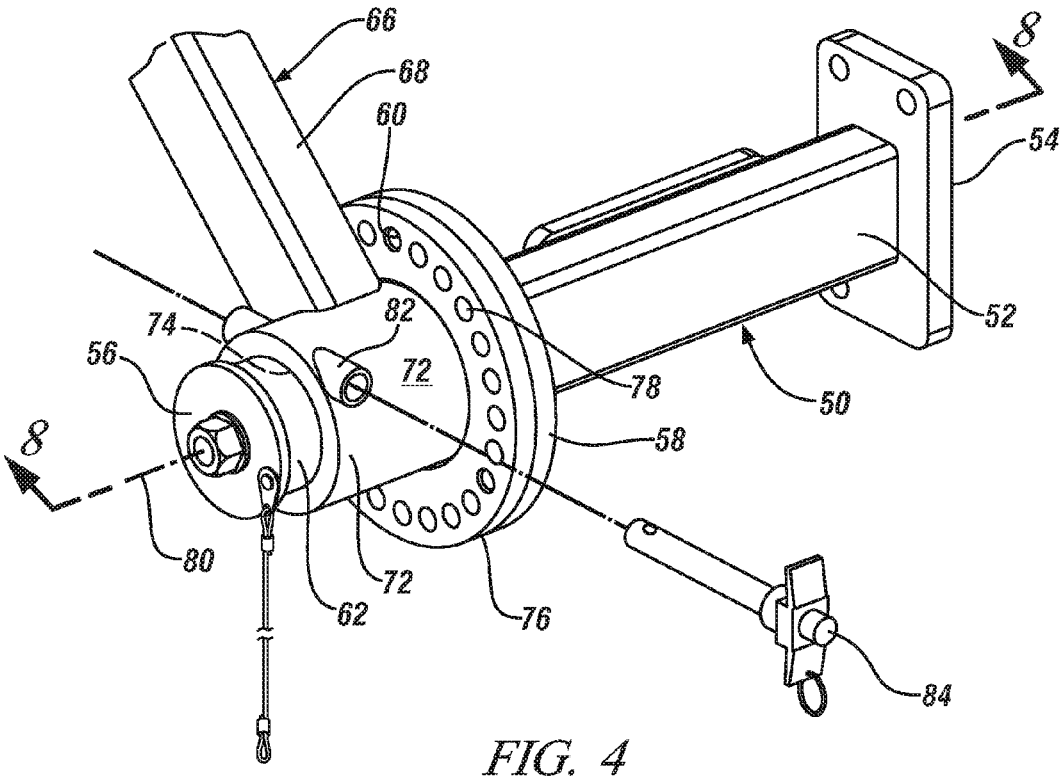
FIG. 4 is an enlarged view of a portion of the pre-skimmer mounting system of FIG. 3 taken at Circle 3.
Figure 5:
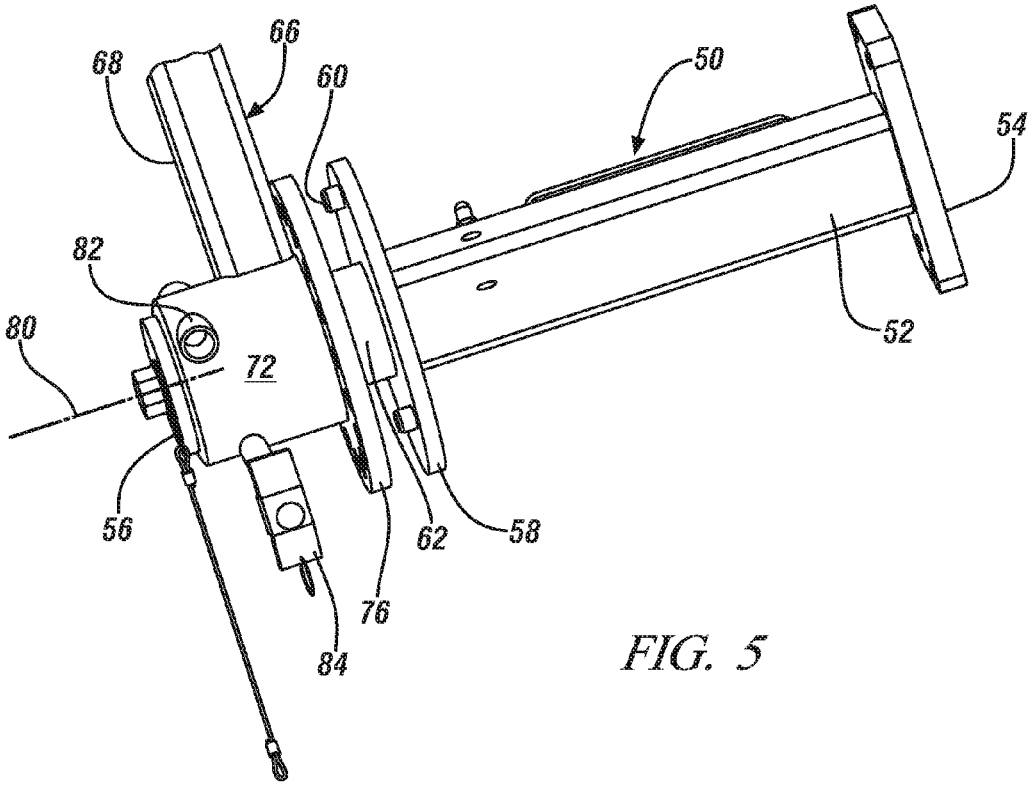
FIG. 5 is an enlarged view of a portion of the pre-skimmer mounting system of FIG. 3 taken at Circle 3 in a second mode of operation.
Figure 8:
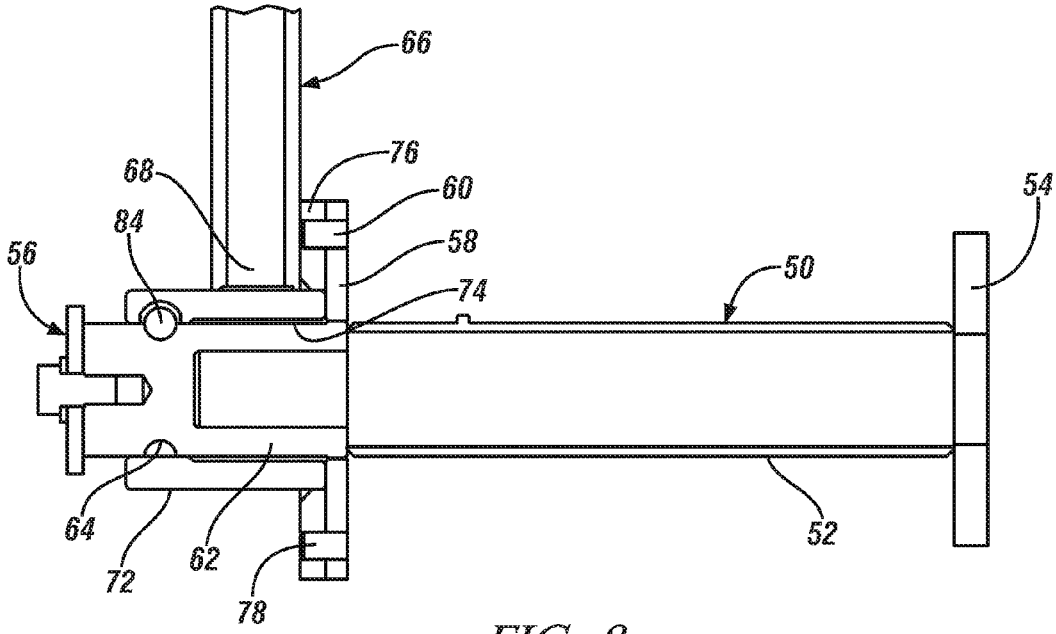
FIG. 8 is a sectional view of a feed mounting arm of the pre-skimmer mounting system taken at Section Line 8-8 of FIG. 4.

Referring to FIGS. 3, 4 and 5, in an exemplary embodiment, an articulated pre-skimmer mount 48 comprises a feed mounting arm 50, having a first end 52 configured for attachment to the drill feed unit 20. Attachment of the feed mounting arm 50 to the drill feed unit 20 may be through the use of a flange 54, which may be fixed to the drill feed unit 20 by welding or through the use of suitable fasteners such as bolts (not shown). Disposed intermediate of the first end 52 and a second end 56 is an axial positioning plate 58, FIGS. 4, 5 and 8, having a plurality of spaced engagement studs 60 extending axially, outwardly therefrom. Extending between the axial positioning plate 58 and the second end 56 of the feed mounting arm 50 is a cylindrical mounting shaft 62 including a locking groove 64 extending circumferentially thereabout.

In an exemplary embodiment, an intermediate arm 66 includes a first end 68 and a second, distal end 70. The first end 68 includes a cylindrical sleeve 72 fixed thereto and having an inner cylindrical opening 74 configured for sliding engagement with the cylindrical mounting shaft 62 of the feed mounting arm 50. Mounted inboard of the cylindrical sleeve 72 (relative to the second end 56 of the feed mounting arm 50) is a mating plate 76 that is configured for face-to-face engagement with the axial positioning plate 58. The mating plate 76 includes a plurality of spaced, locking apertures 78 that extend through and circumferentially about the mating plate 76. The locking apertures 78 include the same radial positioning from the axis 80 of the feed mounting arm 50 as the spaced engagement studs 60 of the axial positioning plate 58. As such, when the mating plate 76 is brought into face-to-face engagement with the axial positioning plate 58 the plurality of spaced engagement studs 60 engage corresponding locking apertures 78 to prevent rotational movement of the cylindrical sleeve 72 and associated intermediate arm 66 about the axis 80 of the feed mounting arm 50. A locking pin receiver 82 extends tangentially through an outer radial portion of the cylindrical sleeve 72 and is configured to receive a locking pin 84 which, when engaged in the locking pin receiver 82 is disposed within the locking groove 64 of the cylindrical mounting shaft 62. In this configuration axial movement of the cylindrical sleeve 72 along the cylindrical mount shaft 62 of the feed mounting arm 50 is prevented and engagement of the spaced engagement studs 60 with the locking apertures 78 is maintained. In the locked configuration movement of the intermediate arm 66 relative to the axis 80 of the feed mounting arm 50 is thereby prevented. It is contemplated that the spaced engagement studs 60 and the locking apertures 78 may, of course be positioned in either of the axial mounting plate 58 and the mating plate 76 without departing from the scope of the present invention. In addition, the use of the spaced engagement studs 60 and the locking apertures 78 may be exchanged for other fixing options such as frictional fixing of the mounting plate 58 and the mating plate 76 relative to one another or through the use of complementary, radially extending grooves which, when the mounting plate 58 and the mating plate 76 are brought into face-to-face engagement, nest within one another to prevent relative movement therebetween. The number and spacing of the locking apertures 78 will determine the angular resolution of movement between the mounting plate 58 and the mating plate 76 during adjustment of the articulated pre-skimmer mount 48, as will be further described below.

In an exemplary embodiment, disposed at the second end 70 of the intermediate arm 66 is a pre-skimmer mount assembly 86. The pre-skimmer mount assembly 86 includes a mounting bracket 88, having a mounting face 90 configured for attachment to pre-skimmer 32. The mounting bracket 88 may be attached to the pre-skimmer 32 by welding or through the use of suitable fasteners, such as bolts (not shown), which extend through the mounting face 90 and into an associated mounting point 92 of the pre-skimmer 32. Mounting bracket 88 may also include a mounting arm 94 extending from the mounting bracket face 90 to terminate in a second cylindrical sleeve 96. The second cylindrical sleeve 96 includes an inner cylindrical opening 98 for sliding engagement on a second cylindrical mounting shaft 100 that extends outwardly from the second end 70 of the intermediate arm 66. Mounted inboard of the second cylindrical sleeve 96 is a second mating plate 102 having a plurality of circumferentially spaced locking apertures 104. The second mating plate 102 is configured to engage in face-to-face relationship with a second axial positioning plate 106 having spaced engagement studs 108 extending axially outwardly therefrom. The spaced engagement studs 108 and the locking apertures 104 are located in the same radial positions relative to the axis 110 of the second cylindrical mounting shaft 100. As a result, when the second mating plate 102 and second axial positioning plate 106 are brought into face-to-face contact the spaced engagement studs 108 engage the locking apertures 104 to prevent movement of the mounting arm 94 and associated mounting bracket 88 relative to the axis 110 of the second cylindrical mounting shaft 100. A locking groove (not shown), similar to locking groove 64 extends circumferentially about the second cylindrical mounting shaft 100. A locking pin receiver 112 is configured to slidingly receive a locking pin 114 therein. When the locking pin 114 is disposed in the locking pin receiver 112 it engages the locking groove in the second cylindrical mounting shaft 100 to prevent axial movement of the second cylindrical sleeve 96 relative to the second cylindrical mounting shaft. It is contemplated that the spaced engagement studs 108 and the locking apertures 104 may, of course be positioned in either of the second axial mounting plate 106 and the second mating plate 102 without departing from the scope of the present invention. In addition, the use of the spaced engagement studs 108 and the locking apertures 104 may be exchanged for other fixing options such as frictional fixing of the second mounting plate 106 and the second mating plate 102 relative to one another or through the use of complementary, radially extending grooves which, when the second mounting plate 106 and the second mating plate 102 are brought into face-to-face engagement, nest within one another to prevent relative movement therebetween. The number and spacing of the locking apertures 104 will determine the angular resolution of movement between the second mounting plate 106 and the second mating plate 102 during adjustment of the articulated pre-skimmer mount 48, as will be further described below.

Referring now to FIGS. 5, 6 and 7, in an exemplary embodiment, the operation of the articulated pre-skimmer mount 48 will now be described. As shown in FIG. 6, the drill feed unit 20 and the pre-skimmer 32 are positioned vertically with respect to the y and the x axes. In this configuration particulates and cuttings 40 received by the pre-skimmer 32 through the first conduit 36 are effectively removed therefrom as a result of the vertical orientation of the pre-skimmer with respect to the x axis (i.e. the ground 46). As shown in FIG. 7, the drill feed unit 20 may be operated at an angle "α" from the vertical or y axis. In order to orient the pre-skimmer 32 in a vertical position (i.e. parallel to the y axis), the locking pin 84 is withdrawn from the locking pin receiver 82 and the cylindrical sleeve 72 is moved outwardly along the axis 80 of the feed mounting arm 50, FIG. 5. Movement of the cylindrical sleeve 72 operates to disengage the spaced engagement studs 60 of the axial positioning plate 58 from the locking apertures 78 of the mating plate 76 allowing rotation of the intermediate arm 66 about the axis 80 of the feed mounting arm 50. Such rotation of the intermediate arm 66 about the axis 80 allows adjustment of the pre-skimmer 32 relative to the x and y axes, FIG. 7, and into position. In like fashion, as shown in FIG. 10, the drill feed unit 20 and the pre-skimmer 32 are positioned vertically with respect to the y and the z axes. In this configuration particulates and cuttings 40 received by the pre-skimmer 32 through the first conduit 36 are effectively removed as a result of the vertical orientation of the pre-skimmer with respect to the z axis (i.e. the ground 46). As shown in FIG. 9, the drill feed unit 20 may be operated at an angle "γ" from the vertical or y axis. In order to orient the pre-skimmer 32 in a vertical position in relation to the y axis (i.e. parallel to the y axis), the locking pin 114 is withdrawn from the locking pin receiver 112 and the second cylindrical sleeve 96 is moved outwardly along the axis 110 of the second cylindrical mounting shaft 100. Movement of the second cylindrical sleeve 96 operates to disengage the spaced engagement studs 108 of the second axial positioning plate 106 from the locking apertures 104 of the second mating plate 102 allowing rotation of the pre-skimmer mounting assembly 86 about the axis 110 of the second cylindrical mounting shaft 100. Such rotation of the pre-skimmer mounting assembly 86 about the axis 110 allows adjustment of the pre-skimmer 32 relative to the z and y axes.

Adjustment of the pre-skimmer 32 in the about the x and the z axes allows the unit to be oriented in a vertical position relative to the ground 46 (i.e. the x and the z axes) to thereby assure the efficient operation of the unit with respect to the removal of large and heavy components 42 of the particulates and cuttings 40 extracted from the bore hole 24. The use of the axial positioning plates 58 and 106 with the corresponding mating plates 76 and 102, which are held in position by quick release locking pins 84 and 114, allow for the rapid adjustment of the pre-skimmer alignment relative to the vertical axis y, when the drill feed unit 20 is operated at and angle α or γ from the vertical axis y, thereby improving the efficiency of the drilling operation.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope thereof.

What is claimed is:

1. An articulated pre-skimmer mount for a pre-skimmer associated with a drill bit feed unit comprising:

a feed mounting arm mounted to, and extending outwardly from the drill bit feed unit comprising:

a first end configured for attachment to the drill bit feed unit;

a second end including a cylindrical mounting shaft;

an axial positioning plate located intermediate of the first and the second ends; and an intermediate arm having a first end comprising a cylindrical sleeve mounted thereto, the cylindrical sleeve having an inner cylindrical opening configured for sliding engagement with the cylindrical mounting shaft and a mating plate located on the sleeve and configured for locking face-to-face engagement with the axial positioning plate, and a second end comprising a pre-skimmer mounting assembly configured for attachment to the pre-skimmer, wherein the axial positioning plate and the mating plate are operable to disengage, for rotation of the intermediate arm about an axis of the feed mounting arm to position the pre-skimmer and to re-engage to fix the pre-skimmer in position.

2. The articulated pre-skimmer mount of claim 1, further comprising:

an engagement stud extending axially outwardly from the axial positioning plate; and a plurality of spaced, locking apertures extending through, and circumferentially about, the mating plate and having a same radial positioning from the axis of the feed mounting arm as the spaced engagement stud of the axial positioning plate, wherein when the mating plate is in face-to-face engagement with the axial positioning plate the engagement stud engages a corresponding locking aperture to prevent rotational movement of the cylindrical sleeve and associated intermediate arm about the axis of the feed mounting arm.

3. The articulated pre-skimmer mount of claim 1, further comprising a plurality of spaced engagement studs extending axially outwardly from the axial positioning plate for engagement with the plurality of spaced, locking apertures.

4. The articulated pre-skimmer mount of claim 2, further comprising:

a locking groove extending circumferentially about the cylindrical mounting shaft; and a locking pin receiver extending tangentially through an outer radial portion of the cylindrical sleeve and configured to receive a locking pin for in the locking groove, wherein axial movement of the cylindrical sleeve along the cylindrical mounting shaft of the feed mounting arm is prevented.

5. The articulated pre-skimmer mount of claim 1, further comprising:

a second cylindrical mounting shaft extending outwardly from the second end of the intermediate arm;

a second cylindrical sleeve configured for sliding engagement with the second cylindrical mounting shaft; and a second mating plate located on the second cylindrical sleeve and configured for locking, face-to-face engagement with a second axial positioning plate mounted to the second cylindrical mounting shaft, wherein the second axial positioning plate and the second mating plate are operable to disengage, for rotation of the pre-skimmer mounting assembly about an axis of the second cylindrical mounting shaft and to re-engage to fix the pre-skimmer in position.

6. The articulated pre-skimmer mount of claim 5, further comprising:

an engagement stud extending axially outwardly from the second axial positioning plate; and;

a plurality of spaced, locking apertures that extend through and circumferentially about the second mating plate and having a same radial positioning from the axis of the feed mounting arm as the spaced engagement stud of the second axial positioning plate, wherein when the second mating plate is in face-to-face engagement with the second axial positioning plate the engagement stud engages a corresponding locking aperture to prevent rotational movement of the second cylindrical sleeve and associated the pre-skimmer mounting assembly about the axis of the second cylindrical mounting shaft.

7. The articulated pre-skimmer mount of claim 6, further comprising a plurality of spaced engagement studs extending axially outwardly from the second axial positioning plate for engagement with the plurality of spaced, locking apertures.

8. The articulated pre-skimmer mount of claim 5, further comprising:

a locking groove extending circumferentially about the second cylindrical mounting shaft; and a locking pin receiver extending tangentially through an outer radial portion of the second cylindrical sleeve, and configured to receive a locking pin for engagement in the locking groove of the second cylindrical mounting shaft.

9. An articulated pre-skimmer mount for a pre-skimmer associated with a drill bit feed unit comprising:

a feed mounting arm mounted to, and extending outwardly from the drill bit feed unit comprising:

a first end configured for attachment to the drill bit feed unit;

a second end including a cylindrical mounting shaft;

an axial positioning plate located intermediate of the first and the second ends;

an intermediate arm having a first end comprising a cylindrical sleeve mounted thereto, the cylindrical sleeve having an inner cylindrical opening configured for sliding engagement with the cylindrical mounting shaft and a mating plate located on the sleeve and configured for locking, face-to-face engagement with the axial positioning plate and a second end comprising a pre-skimmer mounting assembly configured for attachment to the pre-skimmer, wherein the axial positioning plate and the mating plate are operable to disengage, for rotation of the intermediate arm about an axis of the feed mounting arm to position the pre-skimmer, and to re-engage to fix the pre-skimmer in the position;

a second cylindrical mounting shaft extending outwardly from the second end of the intermediate arm;

a second cylindrical sleeve configured for sliding engagement with the second cylindrical mounting shaft; and a second mating plate located on the second cylindrical sleeve and configured for locking, face-to-face engagement with a second axial positioning plate mounted to the second cylindrical mounting shaft, wherein the second axial positioning plate and the second mating plate are operable to disengage, for rotation of the pre-skimmer mounting assembly about an axis of the second cylindrical mounting shaft and to re-engage to fix the pre-skimmer in position.

* * * * *